US006135305A

United States Patent [19]

Brady

[11] Patent Number: 6,135,305

[45] Date of Patent: Oct. 24, 2000

[54] LITTER BINS

[75] Inventor: David William Brady, Cawsand, United Kingdom

[73] Assignee: Seton Limited, Oxon, United Kingdom

[21] Appl. No.: 09/418,183

[22] Filed: Oct. 8, 1999

Related U.S. Application Data

[63] Continuation of application No. PCT/GB99/00496, Feb. 17, 1999.

[30] Foreign Application Priority Data

Feb. 17, 1998 [GB] United Kingdom ..... 9803231

[51] Int. Cl.[7] ..... B65D 83/10

[52] U.S. Cl. ..... 220/481; 220/576; 220/908.3; 200/366

[58] Field of Search ..... 220/481, 210, 220/576, 908.3; 200/366

[56] References Cited

U.S. PATENT DOCUMENTS

| | | | |
|---|---|---|---|
| 2,754,991 | 7/1956 | Hagerty et al. | 220/481 |
| 5,170,907 | 12/1992 | Sakai | 220/481 |
| 5,413,243 | 5/1995 | Bemis et al. | 220/481 |
| 5,419,435 | 5/1995 | Perzan et al. | 220/481 |
| 5,870,969 | 2/1999 | Boyce | 220/481 |
| 5,947,322 | 9/1999 | Ho | 220/481 |

*Primary Examiner*—Joseph M. Moy
*Attorney, Agent, or Firm*—Darby & Darby

[57] ABSTRACT

A cigarette litter bin is provided that includes a mounting element and a receiver element. The receiver is in use, attached to the mounting element by a number of projecting formations engaging with a number of apertures. A biasing means biases the receiver away from the mounting element. The advantage of the bin is that it is faster to remove and replace the receiver from/onto the mounting element than know cigarette litter bins.

20 Claims, 2 Drawing Sheets

LITTER BINS

Figure 1:
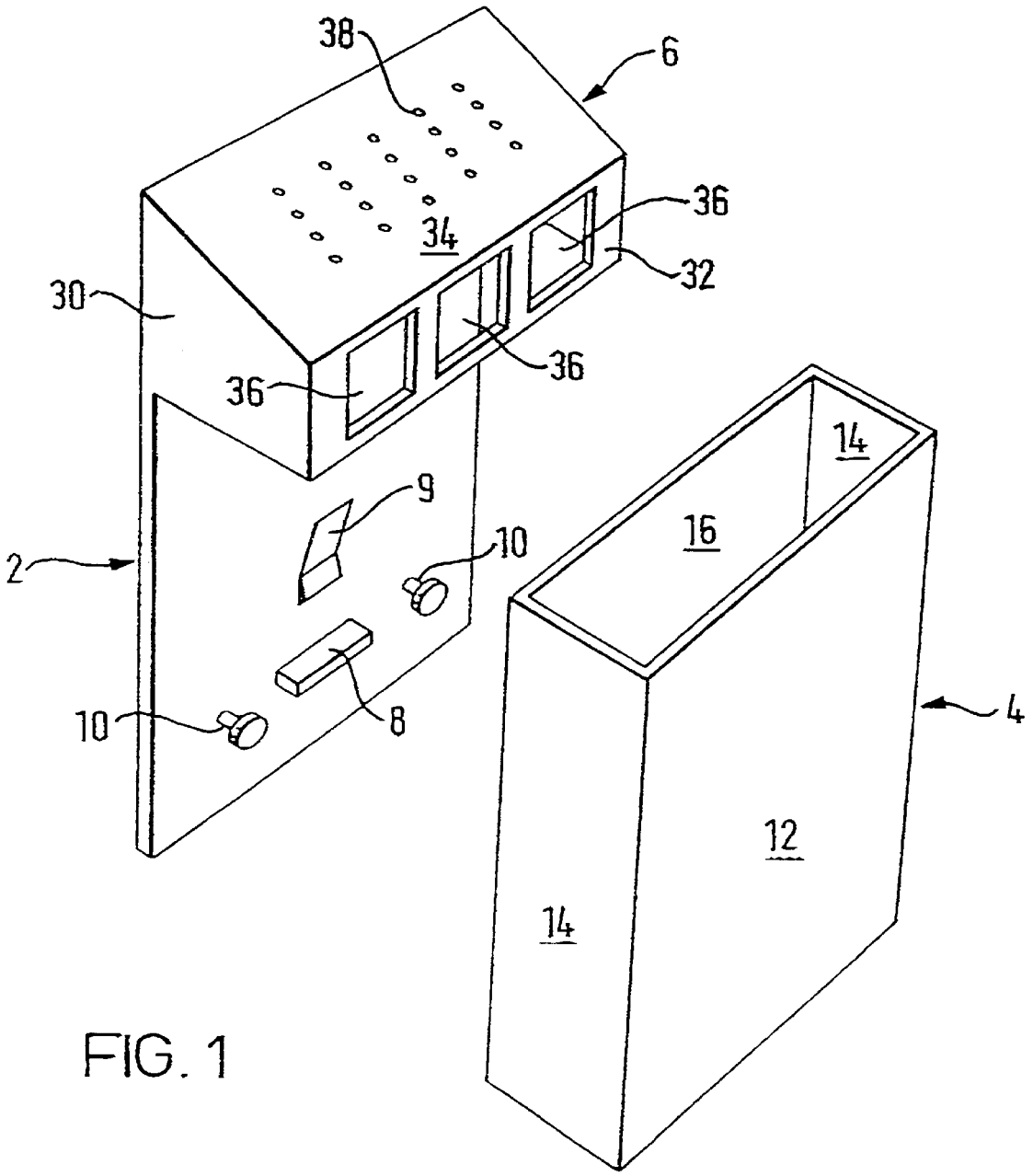

This is a continuation of international application Ser. No. PCT/GB99/00496, filed Feb. 17, 1999.

This invention relates to litter bins and in particular to litter bins for the disposal of cigarette ends, chewing gum and the like.

The litter bins in use at present are of a kind that comprise a mounting element which is secured to a wall, post or other support and a receiver for the cigarette litter which is slidably engageable with the mounting element and removable therefrom for emptying purposes, the receiver normally being locked against disengagement from the mounting element so as to prevent unauthorised removal thereof. A cigarette litter bin of this kind is hereinafter referred to as a "cigarette litter bin of the kind specified".

Known litter bins of kind specified have a number of disadvantages. The main disadvantage is that the method of sliding engagement of the receiver with the mounting element is such that it takes a significant length of time to unlock and disengage the receiver and then to replace it and lock it in position again. For a local authority with a large number of litter bins to empty on a regular basis, the amount of time which it takes to empty the bin is an important factor.

It is accordingly an object of the present invention to provide an improved form of cigarette litter bin of the kind specified in which the method of interengagement between the receiver and the mounting element is such as to reduce the time taken to remove and then replace the receiver.

According to the present invention, there is provided a cigarette litter bin including a mounting element and a receiver element; in which the mounting element includes a mounting plate to which there is attached a hood portion which extends out of the plane of the mounting plate and one or more formation projecting out of the plane of the mounting plate, the direction of projection of the formations being the same as that of the hood; the receiver element is a hollow rectangular faced box with one face being open to form a mouth; characterised in that a rear face of the receiver is adapted to overlie the mounting plate and is provided with a number of apertures corresponding to the number of projecting formations, each aperture being configured so that it comprises a portion into which a projecting formation may be inserted, and a portion that prevents insertion or removal of a projecting formation, and the mounting plate being provided with a biasing means so positioned and configured that when the receiver overlies the mounting plate the receiver is biased away from the mounting plate.

In a preferred embodiment, the apertures in the rear face of the receiver are keyhole shaped and the projections on the mounting plate are substantially "T" shaped in cross section with the formation configured so that the whole of the projection passes through the wider part of the keyhole but not the narrower part. In the most preferred embodiment of the present invention, the keyhole slot is comprised of a circular aperture from which a slot of a smaller width than the diameter of the circular aperture extends in a radial direction.

The projecting formations are most preferably formed by the head of a fastener that is engaged with the mounting plate.

In a preferred embodiment of the present invention, the mounting plate is further provided with a bracket projecting from the plane of the mounting plate, and the receiver is provided with a locking mechanism, the bracket and locking mechanism being so positioned that when the projections are engaged with the aperture the locking mechanism may engage with the bracket and releasably the receiver in position. In a particularly preferred embodiment, the bracket is located in such a position that the locking mechanism is located at the bottom, or end remote from the mouth, of the receiver.

The biasing means of the present invention may be any known biasing means made of any known material. The most preferred type of biasing means is, however, a leaf spring.

When in use, the mounting plate, which is preferably rectangular, is mounted in a substantially vertical plane with the longitudinal axis of the plate substantially vertical. The blood portion is attached to the mounting plate in the region of the upper edge of that plate and the projections attached to the lower portion of the plate.

Assuming that the receiver starts attached to the mounting plate by way of the projecting formations, and the locking mechanism is engaged with the bracket, a user of a cigarette litter bin of the present invention would, disengage the locking mechanism from the bracket. The user would them move the receiver relative to the mounting plate so that it is in such a position that the projecting formations may disengage from the apertures in the receiver. The biasing means constantly be biases the receiver away from the mounting plate and accordingly, when the receiver arrives at such a position, the biasing means causes the receiver to disengage from projecting formations. The receiver may then be lifted away from the mounting plate, and the receiver emptied of any cigarette litter, chewing gum or the like.

Once the receiver is emptied, the receiver is positioned so that wider part of the apertures are over the projecting formations, and the user then pushes against the bias causing the formation to pass through the apertures, the user then moves the receiver relative to the mounting plate so that projecting formations may not then be disengaged from the apertures. The receiver may then be locked back in position if a locking mechanism is present.

An additional advantage of the use of a biasing means in the present invention is that the biasing means helps prevent movement of the receiver relative to the mounting plate when in use, which includes stopping the receiver rattling. Rattling can damage the receiver and/or the mounting plate and prove irritating to people situated near the litter bin.

In a particularly preferred embodiment, the hood portion preferably comprises a pair of side walls, an inclined top wall and a front wall spaced from the mounting plate. The walls being dimensioned so that they, in combination with the mounting plate, surround the mouth of the receiver when it is engaged with the projecting formations.

The hood portion is preferably provided with one or more apertures through which cigarette litter or the like may be inserted. The inclined wall of the hood portion may be provided with or formed into a grill through which a limited quantity of air/smoke may enter/exit the interior of the bin.

The mounting plate is preferably formed with a plurality of fixing apertures to receive the shanks of fasteners to enable the plate to be secured in position, either to a patrice or other form of backing plate or directly to a wall, frame, or other support. There are conveniently four such fixing apertures, two adjacent the lower end of the mounting plate and two adjacent the upper end. Preferably, the two fixing apertures adjacent the upper end of the mounting plate are so positioned that fixings such as screws may be inserted and accessed via one or more apertures in the hood portion.

The cigarette litter may be received directly in the receiver so that when the receiver is removed, it is then emptied before being placed back in position. Alternatively, the receiver may act as a cover for a bag of non-inflammable material which is fastened releasably to the mounting element and is removed and replaced by a new bag when the receiver is removed.

Figure 2:
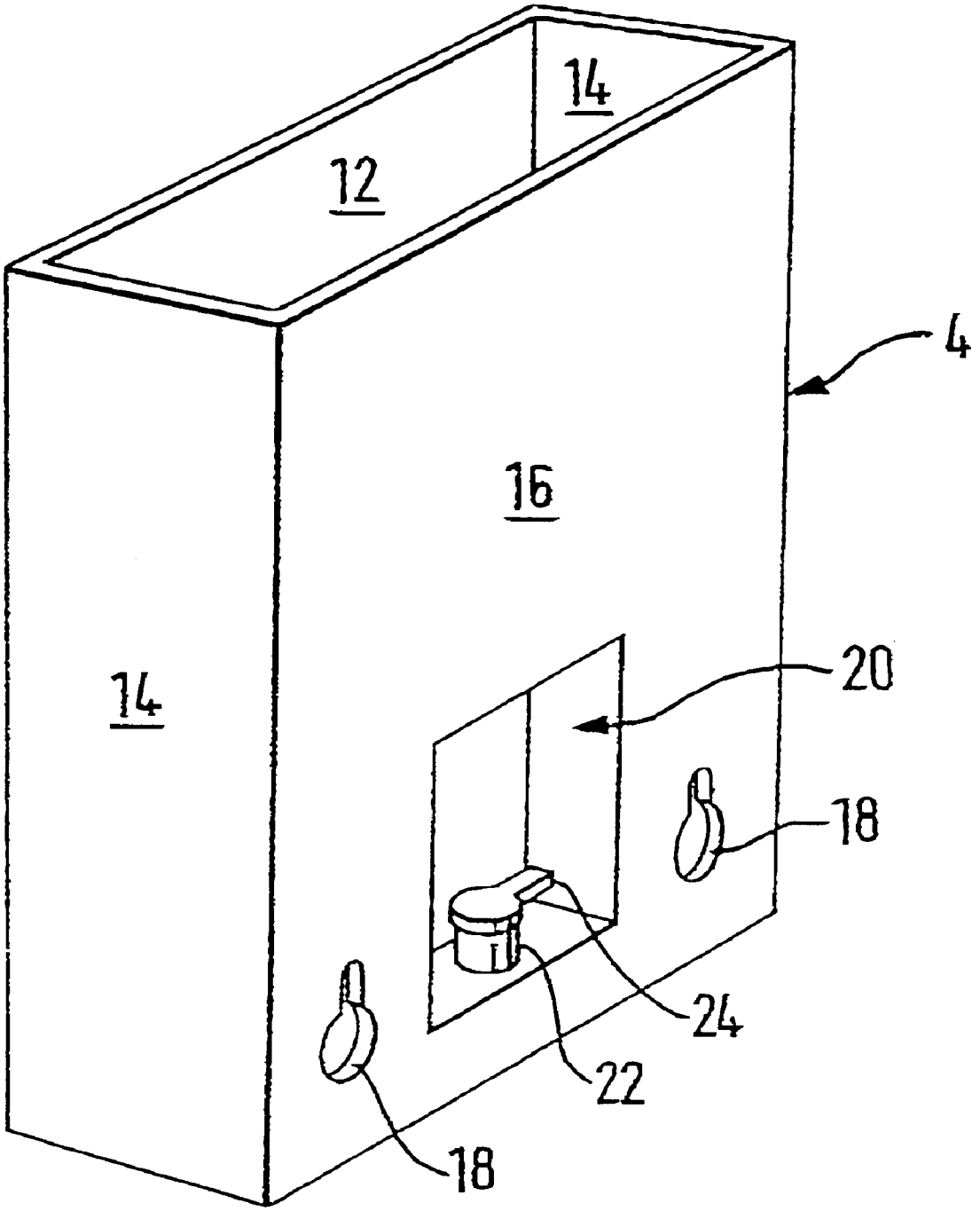

The present invention will be further described and explained with reference to the accompanying drawings in which:

FIG. 1 shows an exploded view of one embodiment of a cigarette litter bin of the present invention; and FIG. 2 shows a perspective view of the rear of the receiver of FIG. 1.

Referring to FIGS. 1 and 2, a cigarette litter bin according to the present invention consists of a mounting plate 2 and a receiver 4. The mounting plate 2 includes a hood portion 6, a bracket 8, a pair of projecting formations 10, and a biasing means in the form of a leaf spring 9. Each of the hood 6, bracket 8, formations 10, and spring 9 project out of the plane of the mounting plate in the same direction.

Hood 6 is formed from a pair of side walls 30, a front wall 32 and a sloping wall 34. Front wall 32 has a series of apertures 36 passing through it, those apertures are of sufficient size to allow cigarette litter to be passed through them. A perforated portion 38 in sloping face 34 allows air or smoke to pass into or out of the hood. As oriented in FIG. 1, an open mouth of the hood 6 faces downward.

The receiver 4 consists of a front wall 12, a rear wall 16, a pair of side walls 14, and a base (not shown). The walls and base are attached to each other to form a rectangular faced box with an open mouth defined by the top (as orientated in FIG. 2) edges of walls 12, 14, and 16. In the rear face 16 are a pair of apertures 18 of a keyhole shape. The narrower portion of the apertures being located above the wider portions of the apertures, and the narrower portions being substantially parallel to the longitudinal axis of rear face 16. Also located in rear face 16 is a recess 20 within which is located a locking mechanism 22. The mechanism 22 extends through the base of the receiver and is so constructed to allow rotation about the mechanisms longitudinal axis. Attached to the upper end of mechanism 22 is a locking bar 24 that extends radially outwards from the mechanism. Rotation of the mechanism is achieved by a user engaging the mechanism from below the base of the receiver with a key and rotating that key.

The apertures 18 are located on rear wall 16 in such a position as to allow insertion of the formations 10 into the wider part of the apertures 18 whilst rear wall 16 overlies mounting plate 2 and the mouth of the receiver is located within hood portion 6. Recess 20 is so positioned on rear wall 16 that when the formations 10 are adjacent or engaged with apertures 18, the bracket 8 projects into recess 20. This has the advantage that it allows the receiver to be located adjacent to mounting plate 2. Locking arm 24 is so located that when the formations 10 are inserted into apertures 18 and receiver 4 moved to the position in which the formations 10 may not be disengaged from the apertures 18, the arm 24 if rotated toward the mounting plate 2 will pass under bracket 8 and not allow the receiver 4 to return to the position in which the formations 10 may be removed from the apertures 18.

Receiver 4 and mounting plate 2 are so dimensioned that when formations 10 are engaged in the narrow part of apertures 18, the mouth of the receiver is at a level higher than the mouth of the hood and lower than the lower edge of apertures 36.

In use, and starting from a position in which the receiver 4 is not mounted on the mounting plate 2, the user inserts the mouth of the receiver 4 in the mouth of the hood 6, and locates the wider portion of apertures 18 in rear wall 16 over formations 10. Receiver 4 is then pushed against the bias provided by spring 9, and formations 10 inserted into apertures 18. Receiver 4 is then slid down (as orientated inn FIG. 1) so that formations 10 enter the narrow portions of apertures 18. Lock mechanism 22 is then rotated so that locking bar 24 passes under bracket 8. The bin is now available for use. The spring 9 prevents receiver 4 from rattling.

To empty the receiver 4, the above steps are reversed, except the user does not have to pull the receiver to withdraw the formations 10 from the apertures 18 because the spring 9 causes that to occur when the receiver 4 is in the correct position.

What is claimed is:

1. A cigarette litter bin including a mounting element and a receiver element;

in which the mounting element includes a mounting plate to which there is attached a hood portion which extends out of the plane of the mounting plate and one or more formations projecting out of the plane of the mounting plate, the direction of projection of the formations being the same as that of the hood;

the receiver element is a hollow rectangular faced box with one face being open to form a mouth;

characterised in that a rear face of the receiver is adapted to overlie the mounting plate and is provided with a number of apertures corresponding to the number of projecting formations, each aperture being configured so that it comprises a portion into which a projecting formation may be inserted, and a portion that prevents insertion or removal of a projecting formation, and the mounting plate being provided with a biasing means so positioned and configured that when the receiver overlies the mounting plate the receiver is biased away from the mounting plate.

2. A cigarette litter bin according to claim 1 in which the apertures in the rear face of the receiver are keyhole shaped and the projections on the mounting plate are adapted to pass through the wider part of the keyhole but not the narrower part.

3. A cigarette litter bin according to claim 2 which the mounting plate is further provided with a bracket projecting from the plane of the mounting plate, and the receiver is provided with a locking mechanism, the bracket and locking mechanism being so positioned that when the projections are engaged with the aperture the locking mechanism may engage with the bracket and retain the receiver in position.

4. A cigarette litter bin according to claim 3 in which the biasing means is a leaf spring.

5. A cigarette litter bin according to claim 4 in which the hood portion includes one or more apertures.

6. A cigarette litter bin according to claim 5 in which the mounting plate is rectangular with the longitudinal axis being substantially vertical in use, the hood portion being attached to the mounting plate in the region of the upper edge of that plate and the projections attached to the lower portion of the plate.

7. A cigarette litter bin according to claim 6 in which the projections are located symmetrically about the longitudinal axis of the mounting plate.

8. A cigarette litter bin according to claim 7 in which the apertures in the rear face of the receiver are keyhole shaped and the wider part of the keyhole is lower than the narrower part, and when the projections are engaged with the apertures, the possible directions of movement of the receiver are up and down.

9. A cigarette litter bin according to claim 2 which the mounting plate is further provided with a bracket projecting from the plane of the mounting plate, and the receiver is provided with a locking mechanism, the bracket and locking mechanism being so positioned that when the projections are engaged with the aperture the locking mechanism may engage with the bracket and retain the receiver in position.

10. A cigarette litter bin according to claim 2 in which the biasing means is a leaf spring.

11. A cigarette litter bin according to claim 2 in which the hood portion includes one or more apertures.

12. A cigarette litter bin according to claim 2 in which the mounting plate is rectangular with the longitudinal axis being substantially vertical in use, the hood portion being attached to the mounting plate in the region of the upper edge of that plate and the projections attached to the lower portion of the plate.

13. A cigarette litter bin according to claim 12 in which the projections are located symmetrically about the longitudinal axis of the mounting plate.

14. A cigarette litter bin according to claim 6 in which the apertures in the rear face of the receiver are keyhole shaped and the wider part of the keyhole is lower than the narrower part, and when the projections are engaged with the apertures, the possible directions of movement of the receiver are up and down.

15. A cigarette litter bin according to claim 3 in which the biasing means is a leaf spring.

16. A cigarette litter bin according to claim 3 in which the hood portion includes one or more apertures.

17. A cigarette litter bin according to claim 3 in which the mounting plate is rectangular with the longitudinal axis being substantially vertical in use, the hood portion being attached to the mounting plate in the region of the upper edge of that plate and the projections attached to the lower portion of the plate.

18. A cigarette litter bin according to claim 17 in which the projections are located symmetrically about the longitudinal axis of the mounting plate.

19. A cigarette litter bin according to claim 3 in which the projections are located symmetrically about the longitudinal axis of the mounting plate.

20. A cigarette litter bin according to claim 3 in which the biasing means is a leaf spring.

* * * * *